United States Patent [19]

Ahlbert et al.

[11] 4,069,595

[45] Jan. 24, 1978

[54] ARRANGEMENT FOR CONVEYING WEB MATERIAL THROUGH A TREATING PLANT

[75] Inventors: Enar Ahlbert; Karl-Hugo Andersson; Ingemar Karlsson; Bengt Oldaeus, all of Vaxjo, Sweden

[73] Assignee: Aktiebolaget Svenska Flaktfabriken, Nacka, Sweden

[21] Appl. No.: 651,232

[22] Filed: Jan. 22, 1976

[51] Int. Cl.[2] ..... F26B 13/02

[52] U.S. Cl. ..... 34/156; 34/160; 226/97

[58] Field of Search ..... 34/156, 160; 226/97; 302/31, 30, 29; 308/DIG. 8; 214/1 BE

[56] References Cited

U.S. PATENT DOCUMENTS

| | | | |
|---|---|---|---|
| 2,920,399 | 1/1960 | Fry, Jr. | 34/159 |
| 3,199,224 | 8/1965 | Brown | 34/160 X |
| 3,475,058 | 10/1969 | Sanders | 302/29 |
| 3,485,429 | 12/1969 | Hutzenlaub | 34/156 X |
| 3,549,070 | 12/1970 | Frost et al. | 34/156 |
| 3,634,948 | 1/1972 | Kobayashi | 34/156 |

FOREIGN PATENT DOCUMENTS

| | | | |
|---|---|---|---|
| 970,871 | 9/1964 | United Kingdom | 226/97 |

*Primary Examiner*—William F. O'Dea
*Assistant Examiner*—Harold Joyce
*Attorney, Agent, or Firm*—Dorfman, Herrell and Skillman

[57] ABSTRACT

A treatment plant for web material which, when bent, exhibits stiffness transverse to the direction of bending. The treatment plant comprises a series of blow boxes arranged in sections with the boxes in each section having parallel plane perforated surfaces on opposite sides of the web path. The perforations are graduated in degree with a high degree of perforation on one side of the web path being opposed by a low degree of perforation on the other side of the web path, and vice versa, so that the web assumes a wave shape between the first and second planes, the wave staying with its nodes in definite positions closer to the one plane opposite the highly perforated group in the second plane and closer to the second plane opposite the highly perforated group in the one plane.

18 Claims, 6 Drawing Figures

ARRANGEMENT FOR CONVEYING WEB MATERIAL THROUGH A TREATING PLANT

This invention relates to treating web material with air. It is particularly directed to apparatus for treating material which, when bent, exhibits stiffness transverse to the direction of bending.

It is previously known to convey material through a plant and subject it to heat treatment by blowing a treating medium against it from both sides while it is being advanced through the plant. The blowing is carried out perpendicularly to the web and thereby yields a high coefficient of heat transfer between the air medium and the material, which coefficient in its turn results in an efficient treatment, for example drying, of the material in question. The material is supported and balanced by the forces produced by the impulses of the air jets and by the air cushion formed between the material and the blower boxes.

Plants of this kind involve the problem that the web can assume a state of fluttering, which especially may arise in a treating plant of great length, in which the web easily is bent in transverse direction so that the web edges scrape on the blower boxes. When the web is coated on one or both sides, such scraping of the web during its transport through the treatment plant can be sufficient to destroy the surface layer on the web. When, for example, a metal foil is to be provided with a surface coat of decorative nature, scraping for obvious reasons must not occur at all, if the finished product shall have a fully satisfactory quality.

The present invention has the object of managing the aforesaid problems and to bring about a treatment plant, which renders it possible to treat a coated foil web with maintained high quality of its surface coat.

This object is achieved by a plant designed according to the characterizing features of the attached claims. The invention, thus, is based on the understanding that, in order to achieve a stable transport of the foil web, the blower boxes must be constructed so, that the web during its passage through the treatment plant assumes wave-shape. This wave shape, in other words, implies that the web in each point has a radius of curvature sufficiently great to render the web stiff in the transverse direction and thereby stabilize the web so that its edges in no point contact the blower boxes.

The invention is described in greater detail in the following, with reference to the accompanying drawings, in which.

Figure 1:
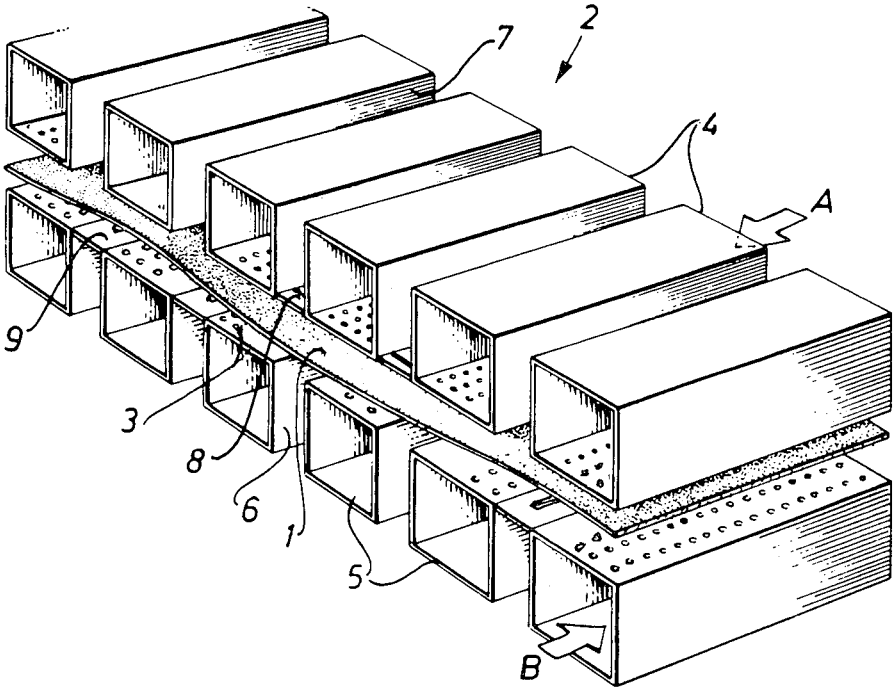
FIG. 1 shows in a perspective view the design of a number of blower boxes arranged in a section of the plant.

In FIG. 1 the numeral 1 refers to a web being advanced through a treatment plant 2 comprising a plurality of blower boxes 5 arranged in a lower plane and blower boxes 4 arranged in an upper plane. The blowing boxes are provided with blow-on apertures 3, which in the embodiment shown are circular holes. The blower boxes are connected to fans (not shown) in such a manner, that the air flows into the blower boxes from either side as indicated by the arrows A and B. The treatment plant further comprises means for treating the air, for example filter means, heating means, etc. The air is evacuated through the gaps 6, 7 between the blower boxes and can be returned all or part of it to the blow-on fans. When the plant is used for drying a coated foil, the evacuated air often has a high content of solvent. In that case, the air can be passed to an installation for combusting the solvent, whereafter the heat energy released can be utilized for heating the blow-on air.

According to the invention, the blower boxes are arranged in groups of boxes with different degrees of perforation. The web passing through the plant hereby assumes a wavy movement. This wavy movement apparently consists of a staying wave, i.e. the node and internode of the wave always will be in a definite position in relation to the blower box. Owing to the wave-shape, the web is stiffened in the transverse direction. This stiffness in its turn contributes to a stabilization of the web and prevents its edges from starting to flutter and thereby to come into contact with the blower boxes. The higher degree of perforation in one group of blower boxes can be combined with means 8, 9 which cover entirely or partially the outlet apertures between the blower boxes. Said means, according to a suitable embodiment, can be made adjustable so as to vary the area of the outlet apertures.

Figure 2:
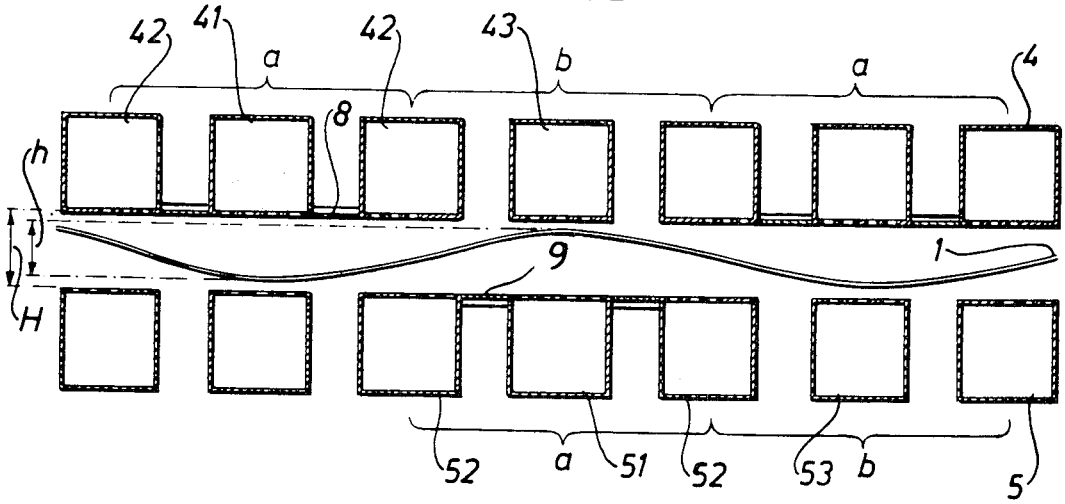
FIG. 2 shows in detail by section a number of blower boxes.

FIG. 2 shows in detail how the blower boxes are arranged in groups with different degrees of perforation. In the Figure, the web is designated by 1, and the blower boxes are designated by 4 and 5. A group of blower boxes with a high perforation degree has the designation *a*, and a group of blower boxes with a low perforation degree has the designation *b*. A blower box, as appears from the Figure, may belong to group *a* as well as to group *b*. Between the blower boxes in group *a*, means 8 and 9 are arranged to cover the outlet apertures entirely or partially. At the embodiment shown, the plant is assembled of three types of boxes, viz. boxes 41, 51 with four rows of blow-on apertures, boxes 42, 52 each with three rows of blow-on apertures concentrated on one side of the box, and boxes 43, 53 each with three rows of blow-on apertures uniformly distributed over the width of the box. The small number of box types has great advantages from the manufacturing aspect. The web running through the plant assumes wave-shape, the double amplitude of which is indicated by *h*. The distance between the two planes of blower boxes is indicated by H. According to a suitable embodiment of the invention, the distances of the blower box planes can be made adjustable in relation to each other, but when H decreases, also *h* decreases so that *h* always is smaller than H. This can be shown with help by the hydrodynamic laws applying to the present web path.

Figure 3:
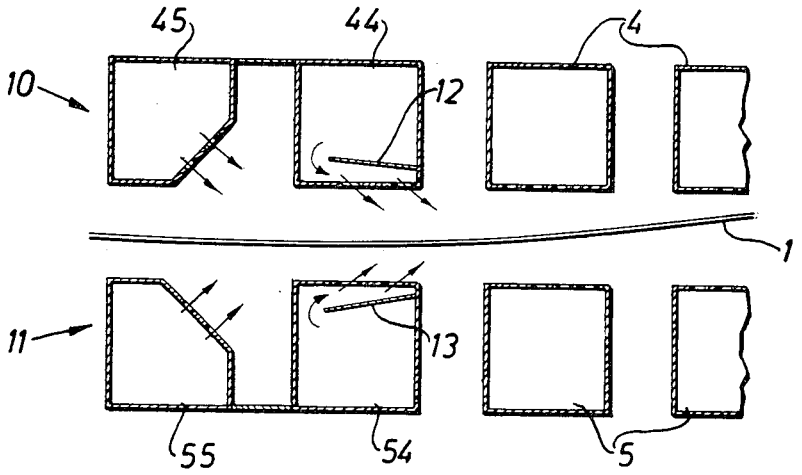
FIG. 3 shows blower boxes arranged at the inlet end or outlet end of a treatment plant.

In FIG. 3 is shown how the treatment plant at its outlet end and/or inlet end can be provided with an air sluice 10, 11 disposed above and beneath the web. The air sluice in the embodiment shown is a blower box 44, 54, which is provided in its interior with a distribution wall 12, 13, by which the air is caused to perform a deflection movement in the box to the effect that the air has an oblique speed component when it flows out through the outlet openings as indicated by the arrows. The air sluice further comprises blower boxes 45, 55 having an inclined plane provided with blow-on apertures whereby the air flowing out is caused to flow in a direction obliquely inwards to the treatment plant. Due to the air sluice, the static pressure is maintained at the blower boxes nearest the outlet end, and the outflow of larger air amounts therethrough is prevented. The same applies, of course, to the inlet end.

Figure 4:
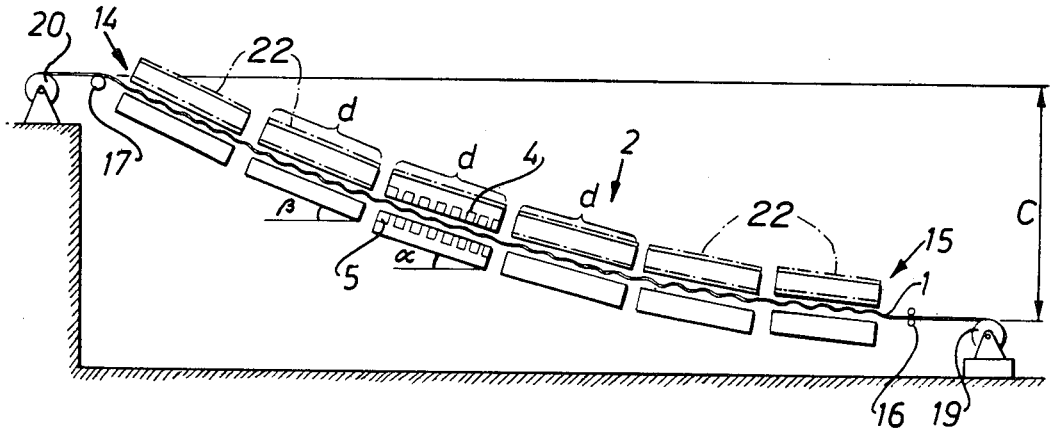
FIG. 4 shows sections of blower boxes arranged along a chain line.
Figure 5:
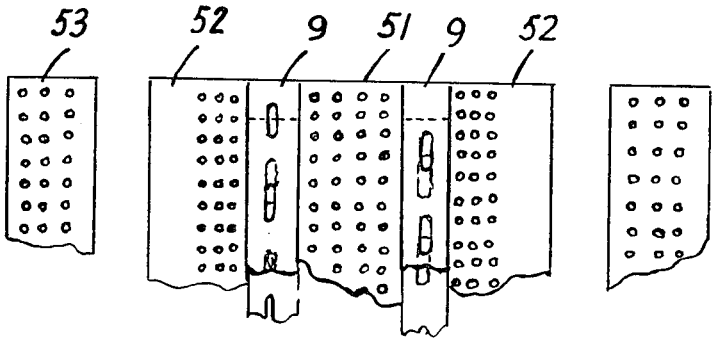
FIG. 5 shows in plan the lower blower boxes of FIG. 2 with the adjustable outlet aperture of claim 4.
Figure 6:
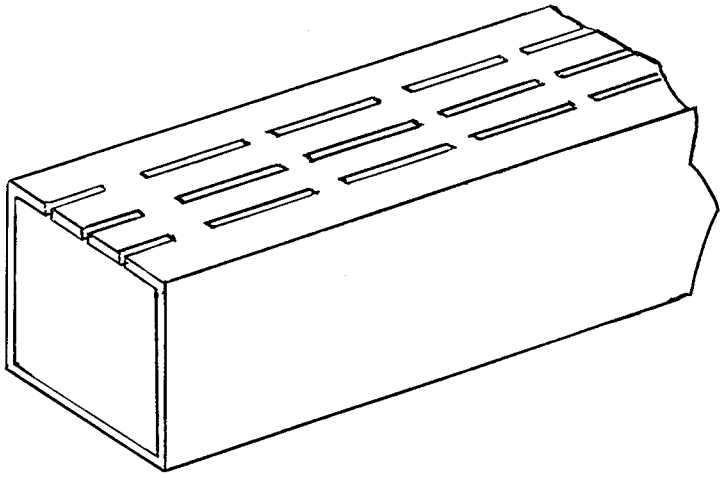
FIG. 6 shows in a perspective view a blower box with slotted blow-on apertures of claim 10.

FIG. 4 shows a treatment plant according to the invention in a case when the inlet end of the plant and outlet end, respectively, are on different levels. In the case shown, the web enters the plant at the inlet end 14 and leaves it at the outlet end 15. The height level of said ends is defined by the rolls 16 and 17. 19 and 20 are rollers for winding the web off and on, respectively. Between these rollers and the treatment plant 2, of course, other types of treatment plants can be arranged, for example a plant for coating the web with ink. The difference in height level is indicated by C. The web between the suspension points assumes a curve shape defined by the equation for a suspended chain. The web tension used, thus, is of decisive importance for the curve-shape of the web. It is to be observed that the own weight of the web substantially is supported by the blower boxes. In order to adjust the treatment plant to the curve-shape of the suspended web, the blower boxes are assembled to section *d*. The boxes in each section may be suspended movably, as indicated at 22, so that the distance between the planes of the upper boxes 4 and the lower boxes 5 may be adjusted, preferably to vary the spacing between 0.05 and 0.3 m. Each section forms an angle $\alpha$, $\beta$ to the horizontal plane. According to the laws of mechanics, $\alpha$ is here $< \beta$, so that two intermediate sections form angles to each other. Owing to the embodiment shown, it is possible to apply the invention even in cases when the inlet and outlet ends are located on different levels. This can practically be very important, because the plant thereby can be adjusted to local conditions. There may also be cases in which for treatment-technical reasons the inlet and outlet ends for the web intentionally are desired to be located on different levels.

The invention is described below by way of an embodiment.

The plant is intended for drying enamelled aluminium sheet metal with a thickness of 0.3 mm and a width of 1.3 m. The total length is about 32 m and comprises five sections. The blower boxes have a length of 1.5 m and a width of 0.34 m. The boxes are uniformly distributed over sections with a spaced relationship of 0.4 m. The distance between two adjacent blower boxes is 0.06 m corresponding to the width of the outlet gap. The inlet end of the plant is located 0.4 m higher than its outlet end. The first blower box section is inclined 2.3° to the horizontal plane, and the second one 1.4°. The remaining sections lie horizontally.

The plant operates as follows.

The coated web is conveyed through the treatment plant at 1.5 m/s. It first enters the first section where air with a temperature of 370° is blown against the web. The mean perforation degree of this section, i.e. calculated on groups with both high and low perforation degree, is 3.5%, and its drain degree is 7.5%. The total flow of blown-on air is 60,000 $m^3/h$. The passing speed of the air through the blow-on apertures is 40 m/s. At this section the distance between the blower-box planes is adjustable between 0.05 and 0.3 m. The waves of the wavy movement of the web have a length of 0.8 m.

The web after having passed through the first section enters the second section where the air, as in the first section, has a temperature of 370° C while the air flow is smaller, viz. 36,000 $m^3/h$. The distance between the blower-box planes is fixed to 0.1 m, as in the following sections. The mean perforation degree calculated according to above is 2.1% and its drain degree is 2.3%.

In the third and fourth section the air flow is 20,000 $m^3/h$, and the air has a temperature of 425° C. After having passed through the first four sections, the web enters a cooling section of 4.5 m in length. Also here the air flow is 20,000 $m^3/h$, but the air temperature is 120° C. At this section the air at the blow-on apertures has a speed of 25 m/s. The mean perforation degree is here 1.2%, and the drain degree is 0.

We claim:

1. An arrangement for conveying a web such as a foil of metal, plastics or another material, which upon single curving shows stiffness transverse to the direction of curving, and which preferably is coated on one or both sides, through a treatment plant, comprising a plurality of blower boxes, arranged adjacent each other with perforations providing blow-on apertures in a first plane above and a second plane below the web, said boxes extending transversely to the web, said blow-on apertures having a certain degree of perforation for blowing a medium, such as air, perpendicularly against the web, and outlet apertures for draining the treating medium between said boxes, characterized in that the blower boxes are arranged in periodically repeated groups located adjacent each other, one group thereof comprising blower boxes with a high perforation degree and the other group comprising blower boxes with a low perforation degree, and that a group with high perforation degree in one plane is located directly in front of a group with low perforation degree in the other plane so that the web assumes a wave shape between the first and second planes, said wave staying with its nodes in definite positions closer to the one plane opposite the highly perforated groups in the second plane, and closer to the second plane opposite the highly perforated groups in the one plane.

2. An arrangement according to claim 1, characterized in that the one group of blower boxes includes intermediate outlet apertures having a total discharge area which is relatively small, and that the other group of blower boxes includes intermediate outlet apertures having a relatively large total discharge area.

3. An arrangement according to claim 2, characterized in that the blower boxes are of equal size and are uniformly distributed, and that the spaces between the blower boxes with high perforation degree are provided with covering means at least partially covering said space to provide said outlet apertures with small discharge area.

4. An arrangement according to claim 3, characterized in that the covering means are provided with means for adjusting the discharge area of the outlet apertures.

5. An arrangement according to claim 1, characterized in that the blow-on apertures of the one group of blower boxes are arranged symmetrically about the centre line of the group, and that the perforation degree decreases successively with the distance from the centre line.

6. An arrangement according to claim 1, characterized in that the blow-on apertures at the other group of blower boxes are arranged symmetrically about the centre line of the group, and that the perforation degree increases successively with the distance from the centre line.

7. An arrangement according to claim 1, characterized in that both groups of blower boxes include a first blower box provided with a plurality of parallel rows of blow-on apertures distributed uniformly over the width of the blower box, and that on each side thereof additional blower boxes are arranged comprising parallel rows of blow-on apertures distributed non-uniformly over the width of the blowing boxes.

8. An arrangement according to claim 1, characterized in that the mean perforation degree, calculated on groups of blower boxes with high perforation degree and groups of blower boxes with low perforation degree, is between 1% and 5% and that the corresponding degree of the outlet apertures is between 0 and 10%.

9. An arrangement according to claim 1, characterized in that the blow-on apertures of the blower boxes are circular holes.

10. An arrangement according to claim 1, characterized in that the blow-on apertures of the blower boxes are slots extending along the length of the blower box.

11. An arrangement according to claim 1 having means to supply treating medium to said blower boxes, characterized in that the blow-on apertures and the means for supplying treating medium to the blower boxes are so dimensioned that the speed of the treating medium through the blow-on apertures is between 20 m/s and 50 m/s.

12. An arrangement according to claim 1 including means to suspend at least one group of blower boxes movably so that the distance between the blower-box planes can be adjusted.

13. An arrangement according to claim 12, characterized in that the distance between the blower-box planes can be adjusted by said suspension means to a spacing of between 0.05 and 0.3 m.

14. An arrangement according to claim 1, characterized in that the inlet end of the plurality of blower boxes is located in one level, and its outlet end is located in another level separated vertically from said first level.

15. An arrangement according to claim 14, characterized in that a plurality of groups of blower boxes with high perforation degree and low perforation degree, respectively, form a section of blower boxes, which is located adjacent at least one other section of blower boxes, and that the first planes of adjacent sections form an angle to each other, and the second planes of adjacent sections form an angle to each other.

16. An arrangement according to claim 15, characterized in that the inclination of each section substantially corresponds to the inclination of one link of an imagined chain suspended between the inlet end and outlet end, each link of said chain corresponding to the length of the associated section.

17. An arrangement according to claim 1, including at least one of the inlet end and outlet ends of the treatment plant, an air sluice above and below the web for blowing sluice air in to the treatment plant.

18. An arrangement according to claim 17, characterized in that the air sluice comprises blower boxes with the blow-on apertures arranged in an inclined plane to produce an air flow directed obliquely inward toward the treatment plant.

* * * * *

UNITED STATES PATENT OFFICE

CERTIFICATE OF CORRECTION

Patent No. 4,069,595 Dated January 24, 1978

Inventor(s) Enar Ahlbert; Karl-Hugo Andersson; Ingemar Karlsson; and Bengt Oldaeus It is certified that error appears in the above-identified patent and that said Letters Patent are hereby corrected as shown below:

In the heading before [51] Int. Cl., the following foreign priority data should be added:

--- [30] Foreign Application Priority Data

January 24, 1975 Sweden .....7500778-1 ---;

Signed and Sealed this

Ninth Day of May 1978

[SEAL]

Attest:

RUTH C. MASON
Attesting Officer

LUTRELLE F. PARKER
Acting Commissioner of Patents and Trademarks